US006517010B1

(12) United States Patent
Barykin et al.

(10) Patent No.: US 6,517,010 B1
(45) Date of Patent: Feb. 11, 2003

(54) SYSTEM FOR INJECTING GAS INTO A DETONATION PROJECTION GUN

(75) Inventors: Georgy Yur'evich Barykin, Irun (ES); Inaki Fagoaga Altuna, Irun (ES)

(73) Assignee: Aerostar Coating, S.L., Irun (ES)

( * ) Notice: Subject to any disclaimer, the term of this patent is extended or adjusted under 35 U.S.C. 154(b) by 0 days.

(21) Appl. No.: 09/508,446

(22) PCT Filed: Sep. 11, 1997

(86) PCT No.: PCT/ES97/00223

§ 371 (c)(1),
(2), (4) Date: Jun. 19, 2000

(87) PCT Pub. No.: WO99/12653

PCT Pub. Date: Mar. 18, 1999

(51) Int. Cl.[7] ..... F23D 11/10

(52) U.S. Cl. ..... 239/79; 239/80; 239/398; 239/418; 239/422; 239/427.3; 239/427.5; 239/428; 239/429; 239/430; 239/553; 239/553.3; 239/553.5

(58) Field of Search ..... 239/79, 80, 398, 239/418, 422, 423, 426, 427.3, 427.5, 428, 429, 430, 433, 434, 553, 553.3, 553.5, 590, 590.3, 590.5; 89/7

(56) References Cited

U.S. PATENT DOCUMENTS

| | | | | | |
|---|---|---|---|---|---|
| 505,931 | A | * | 10/1893 | Thurman | 239/428 |
| 795,044 | A | * | 7/1905 | Kraus | 239/427.3 |
| 3,044,363 | A | * | 7/1962 | Musser | 89/7 |
| 3,763,936 | A | * | 10/1973 | Menage | 239/453 |
| 4,004,735 | A | | 1/1977 | Zverev et al. | 239/79 |
| 4,215,819 | A | | 8/1980 | Garda et al. | 239/81 |
| 4,231,518 | A | | 11/1980 | Zverev et al. | |
| 4,258,091 | A | | 3/1981 | Dudko et al. | |
| 4,319,715 | A | | 3/1982 | Garda et al. | 239/81 |
| 4,569,479 | A | | 2/1986 | Suwa et al. | |
| 4,669,658 | A | | 6/1987 | Nevgod et al. | 239/81 |
| 4,687,135 | A | | 8/1987 | Nevgod et al. | 239/81 |
| 4,809,911 | A | * | 3/1989 | Ryan | 239/434.5 |
| 4,953,440 | A | * | 9/1990 | Moscrip | 89/7 |
| 5,052,619 | A | | 10/1991 | Ulyanitsky et al. | 239/79 |
| 5,542,606 | A | | 8/1996 | Kadyrov et al. | |
| 6,212,988 | B1 | * | 4/2001 | Chernyshov et al. | 89/7 |

FOREIGN PATENT DOCUMENTS

| | | |
|---|---|---|
| EP | 0 361 710 A1 | 4/1990 |
| EP | 0 513 497 A1 | 11/1992 |
| FR | 2588018 | 4/1987 |
| GB | 2100145 A | 12/1982 |
| GB | 2192815 A | 1/1988 |
| GB | 2285062 | 6/1995 |
| WO | WO 97/23298 | 7/1997 |
| WO | WO 97/23300 | 7/1997 |
| WO | WO 97/23303 | 7/1997 |

* cited by examiner

*Primary Examiner*—Robin O. Evans
(74) *Attorney, Agent, or Firm*—Blake T. Biederman

(57) ABSTRACT

The system for injecting gas for a detonation projection gun does not incorporate mechanical closing valves or systems for the supply of combustible gas or other inert additive compounds such as nitrogen, argol, helium or the like. On the contrary, the supply of gas or compounds occurs directly and separately to the detonation chamber (1) through a series of independent passages, one for the comburant and at least another passage for the combustibles, each passage being comprised of an expansion chamber (8) and of a plurality of distribution conduits (9) having a reduced cross-section and/or extended length. The expansion chamber (8) of each passage communicates directly with the corresponding supply line (4) whereas the distribution conduits (9) are conveniently distributed so that multiple gas injection points open out at the internal surface of the combustion chamber (1) in order to produce a continuous and separate supply of gas at multiple points thereby ensuring a direct and homogenous combustible mixing in the combustion chamber (1) and with a flow which is sufficient to fill the chamber (1) in each detonation cycle.

19 Claims, 5 Drawing Sheets

SYSTEM FOR INJECTING GAS INTO A DETONATION PROJECTION GUN

OBJECT OF THE INVENTION

The present invention relates to the field of thermal spray technologies for applying coatings and in particular to detonation thermal spray.

The object of the present invention is a gas feeder apparatus for a detonation spray gun which provides a high safety of use as well as a greater productivity and versatility.

BACKGROUND OF THE INVENTION

At this time, detonation spray technology is mainly used to apply coatings to workpieces exposed to severe wear, heat or corrosion and is fundamentally based on using the kinetic energy produced in the detonation of combustible mixtures of gases to deposit powdered coating materials on workpieces.

Coating materials typically used in detonation processes include powder forms of metals, metal-ceramics and ceramics and are applied to improve resistance to wear, erosion, corrosion, as thermal insulators and as electrical insulators or conductors.

Spraying by detonation is performed by spray guns which basically consist of a tubular detonation chamber, with one closed end and one open end, to the latter being attached an also tubular barrel. A combustion mixture is injected into the detonation chamber and ignition of the gas mixture is achieved with a spark plug, causing a detonation and consequently a shock or pressure wave which travels at supersonic speeds inside the chamber and then inside the barrel until it leaves through the open end of the barrel.

The coating material powder is generally injected into the barrel in front of the propagating shock wave front and is then carried out to the open end of the barrel and deposited onto a substrate or workpiece placed in front of the barrel. The impact of the coating powder onto the substrate produces a high-density coating with good adhesive characteristics.

This process is repeated cyclically until the workpiece is adequately coated.

In a typical detonation gun, the gases which make up the mixture to be detonated, oxygen and a fuel such as natural gas, propane, propylene, hydrogen or acetylene are mixed before they enter the detonation chamber in a mixing chamber, to ensure the homogeneity of the mixture in the detonation chamber at the time of explosion. The chamber or conduits in which the gases are mixed make up a volume in which flame and shock wave returns must be absent, to prevent backfiring into the fuel and oxygen supplies. This basic safety requirement is solved in traditional devices in three basic ways:

a) Detonation systems in which the mixing chamber, the detonation chamber and the gas feeding supplies are isolated by a valve system synchronized with the firing system. In this arrangement, valves open to allow the gases to pass into the premixture chamber and from it to the detonation chamber and close during the explosion to isolate the feeding supplies from the detonation chamber. Devices of this type are described in U.S. Pat. Nos. 4,687,135 and 4,096,945.

This is a solution widely used but its main disadvantage refers to the fact that the valve system complicates the apparatus and uses mechanical moving parts, which causes reliability problems and limits the productivity. In these devices, the detonation wave is stopped from advancing by filling the mixing chamber with an inert gas such as nitrogen or a noble gas which prevents propagation inside it.

b) U.S. Pat. No. 4,258,091 refers to a method for applying coatings in which the fuel gases are fed continuously into a mixing chamber and from there they pass, through a pipe, into the detonation chamber. To achieve a cyclically and controlled feeding of the mixed gases into the detonation chamber, an inert gas is fed to an intermediate area of the communication pipe between the mixing chamber and the detonation chamber. The injection of the inert gas into the pipe is controlled cyclically by a valve, so that volumes of gas mixture and inert gas arrive in an alternate manner at the detonation chamber. The volume of inert gas allows controlling the adequate mixture volume for detonation and also prevents backfiring into the mixing chamber.

The main disadvantage of this device is its low productivity.

c) Detonation apparatus in which the mixing chamber is communicated with the detonation chamber by a labyrinth-like tortuous path or conduit, which precludes the propagation of the detonation wave by collision of the detonation cells, which make up the shock wave, against the labyrinth walls, so that the wave loses enough pressure not to be able to propagate through the gas feeding supplies. Such an apparatus is described in PCT Patent US96/20160 of the applicant.

In this case, the tortuous path or labyrinth presents a particular geometry which depends on the composition of the gas mixture, since the size of the detonation cells depends on the mixture, and so the labyrinth must be specifically designed to cause the annihilation of the cells which propagate in it. This has the disadvantage that the equipment is designed to annihilate cells corresponding to certain fuel mixtures; a new labyrinth design or, at best, a rearrangement of its geometry is required for safe use with a different gas mixture, which generates cells of different size.

Even for a same pair of gases the labyrinth design can only ensure safety of the system in a limited composition interval of the mixture and pressure of the gases in the combustion chamber.

Another important disadvantage of this type of systems relates to the fact that since there is free communication between the detonation chamber and the mixing chamber it is not possible to completely eliminate backfiring into the mixing chamber, so that between successive detonations there is a combustion of gases contained in the latter. When these gases burn inside the mixing chamber, ashes and soot are created which are deposited on the chamber walls and on the gas feeding conduits, possibly even obstructing these, so that it is necessary to periodically clean and maintain these.

A similar solution to the above one and therefore with the same disadvantages mentioned is described in U.S. Pat. 5,542,606. In this Patent, combustion of the gases occurs in the gas mixing chamber itself, propagating through narrow conduits until a larger chamber is reached where the detonation occurs.

DESCRIPTION OF THE INVENTION

The present invention fully solves the above disadvantages by a continuous gas feeding system which communicates directly and separately the oxygen and fuel gases supplies with the detonation chamber without there being an intermediate chamber or conduit where the fuel gases and oxygen mix before they arrive at the detonation chamber.

The apparatus of the invention have no valves or moving parts to close communication between the detonation chamber and the gas feeding supplies and consists only of a series of independent passages for each of the gases, the design and size of which allow obtaining cyclical detonations with a continuous gas feeding, in addition guaranteeing a fast and thorough distribution of gases in the detonation chamber to obtain a fast and efficient homogeneity of the mixture.

More specifically, each of the independent passages which communicate the feeding supplies to the detonation chamber consists of an expansion chamber and a number of distribution conduits of small cross section and/or great length, so that each gas arrives at the detonation chamber separated from the other gas and through a number of small orifices, as in a shower head, guaranteeing a correct spatial distribution of the gases inside the detonation chamber and thereby a proper homogeneity of the mixture produced in the detonation chamber prior to the explosion.

Once the detonation occurs, the pressure wave generated travels in all directions, mainly through the barrel, but also through the multiple gas distribution passages which open into the detonation chamber. Due to the geometry of these, the progression of the gases through the distribution passages takes place with difficulty so that the gases lose a great deal of heat by thermal transmission to the outer surface of the conduits, cooling down to a temperature below that of ignition of the mixture.

After this, when the main volume of detonation gases passes out through the barrel, the gases which traveled in the distribution conduits are suctioned in, returning already cooled to the detonation chamber, forming a volume of cold gases which is located immediately behind the hot detonation gases, thus acting as a thermal barrier between the very hot detonated gases and the new volume of gases which enters the chamber for a new detonation cycle. This volume of cold gases prevents the detonated gases from being in direct contact with the new volume of gases, thus avoiding the propagation of combustion to the new gases, that is, the cooled detonated gases inside the distribution conduits act as a barrier separating cyclically volumes of gases which cause combustion and therefore detonate cyclically.

As has been exposed, this injection system based on a set of independent passages, consisting of a number of conduits of reduced cross section and/or great length, converts a continuous feeding of gases into cyclical detonations inside the detonation chamber.

In addition, the device also acts as a safety valve, preventing the pressure wave from reaching the gas feeding supplies after each explosion since the special geometry of the distribution conduits makes the gas advance slowly inside them, so that before the pressure wave front reaches the feeding supplies all the explosion volume has left through the barrel and therefore the pressure of the wave rapidly disappears.

Nevertheless, the system is intrinsically safe as there is no volume of explosive mixture, oxygen and combustion gas, in any chamber or conduit of the device except the detonation chamber. This means that even in the case of backfiring, there would be no serious consequences as neither the oxygen nor the fuel (except acetylene) can burn on their own, much less explode.

With the system described, the spray frequency is greater than in present equipment due to the fact that there are no moving parts and it is not necessary to refill the gas and oxygen volumes of the mixing chamber between successive discharges which in other systems are lost through combustion. This means that a faster refill of the detonation chamber can be obtained and therefore a higher working frequency can also be obtained.

The apparatus of the invention is placed directly between the gas feeding supplies and the detonation chamber and can be made in the walls of the chamber itself, as a rod or cylinder placed axially behind the chamber, or preferably as one or several caps internally connected to the detonation chamber. When the expansion chambers are placed around the perimeter of the aforementioned caps, they may occupy an arc of circumference or the full circumference, where in the first case the feeding lines must be arranged radially with respect to the detonation chamber.

Finally, the described system shows greater flexibility than known systems in that there is no limitation as far as the type of gas to be used, in other words, it is not necessary to adapt or modify the detonation gun even if different gases or mixtures of gases are used.

DESCRIPTION OF THE DRAWINGS

To complement the description being made and in order to aid a better understanding of the characteristics of the invention, attached to the present descriptive memory as an integral part of it is a set of drawings, where in an illustrative and non-limiting nature, the following is shown.

PREFERRED EMBODIMENT OF THE INVENTION

Figure 1:
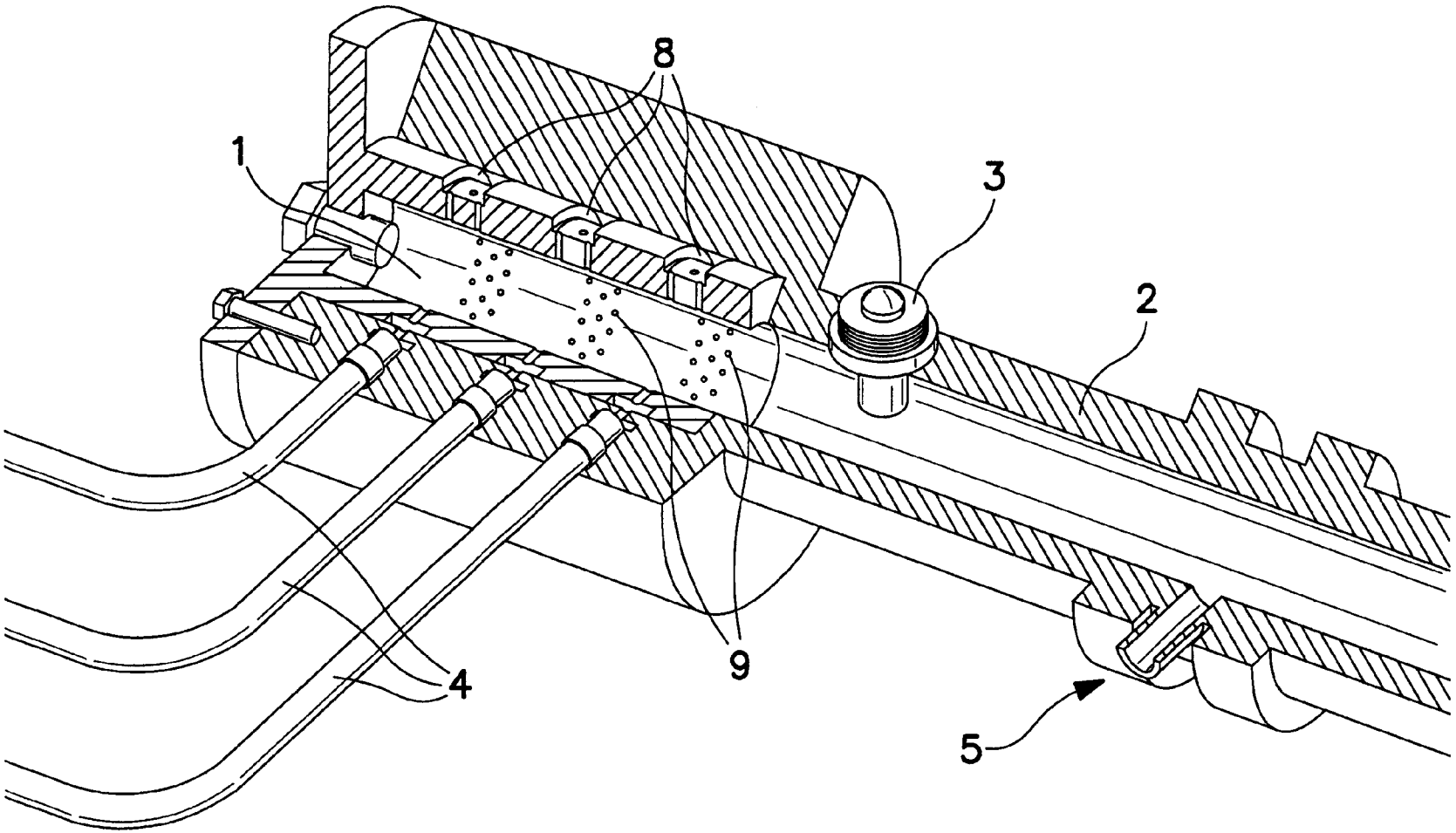
FIG. 1 shows a sketch of a detonation spray device according to the object of the invention, in which the explosive mixture is obtained from a fuel, nitrogen gas and oxygen.

As seen in FIG. 1, a detonation gun basically consists of a detonation chamber (1) of cylindrical shape and a barrel (2), also cylindrical, connected to the open end of the combustion chamber. The combustion chamber is provided with a spark plug (3) which provides the ignition of the combustible mixture.

The combustible gases reach the detonation chamber through feeding conduits (4) while the coating powder is fed to the barrel (2), consequently in an area located after the detonation chamber.

The gas feeding system object of the invention, as seen in all of the figures, allows feeding gases directly and independently to the detonation chamber (1) without performing a previous mixture of these gases before they reach the detonation chamber (1).

More specifically, the proposed feeding system consists of a series of independent passages, each of which in turn consists of an expansion chamber (8) and a number of distribution conduits (9) which communicate the expansion chamber (8) with the detonation chamber (1) through several points, which allow rapid injection of these gases and good spatial distribution in detonation chamber (1), ensuring a good homogeneity of the mixture before its combustion.

Distribution conduits (9) have a small cross section and/or a large length, so that the detonation gases passing through them lose enough heat to make their temperature decrease inside said conduits (9) to a value below the combustion temperature of the mixture, creating a thermal barrier between the detonated gases and the following volume of gases which will fill the detonation chamber. In this way and simply by the geometrical characteristics of the gas feeding passages it is possible to obtain cyclical detonations using continuous gas feeding.

Figure 2:
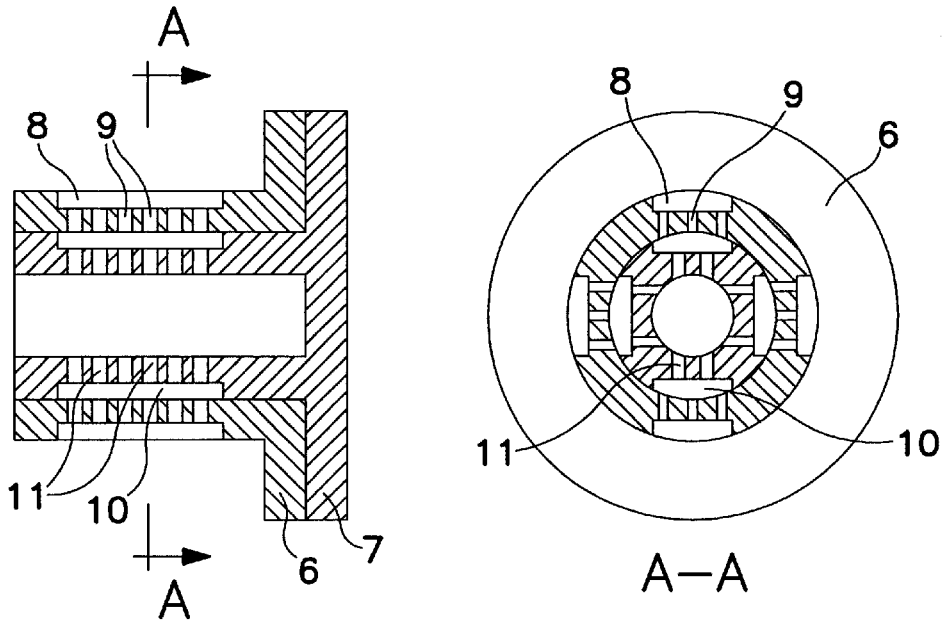
FIG. 2 shows an embodiment in which the gas injection system consists of two concentric caps both provided with an expansion chamber and a number of distribution orifices which communicate to the detonation chamber.
Figure 3:
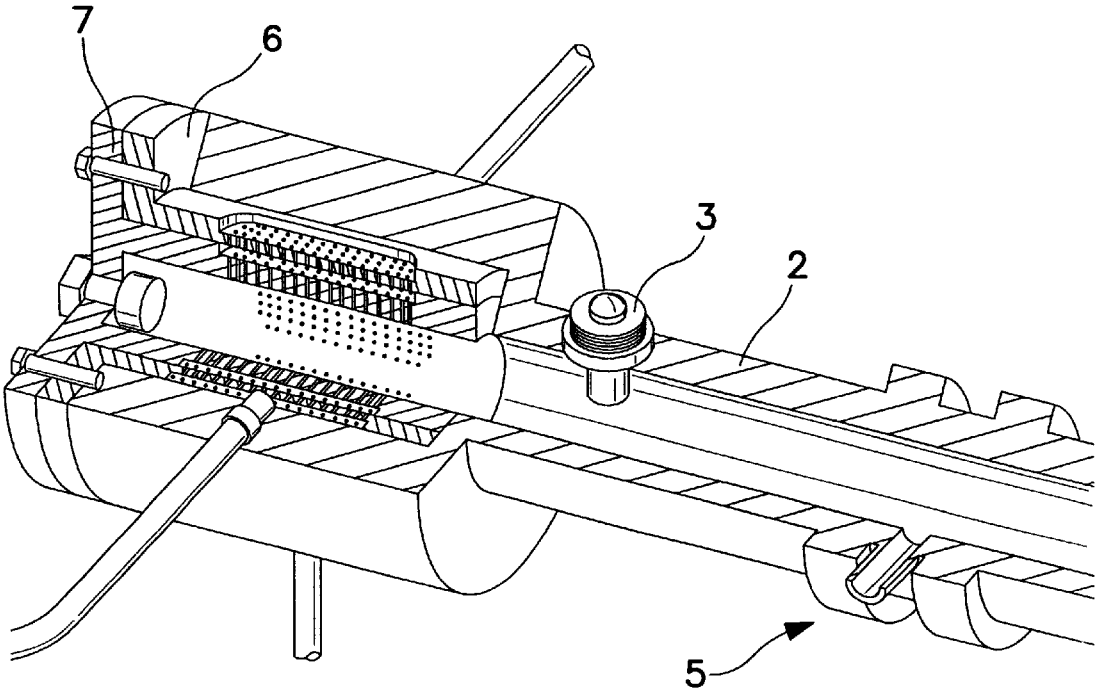
FIG. 3 shows a perspective view of the embodiment shown in FIG. 2, that is, where the feeding system consists of a cap provided with annular expansion chambers and a number of distribution orifices.

FIGS. 2, 3, 4, 5, 6, and 7 show different embodiments for the gas feeding system object of the invention; specifically, in FIGS. 2 and 3 the feeding system consists of two concentric annular caps (6) (7) which are placed inside the detonation chamber also closing it on its rear end. In each of the caps the gas feeding passages consist of a set of channels (8) (10), forming annular sectors which define an equal number of radial and independent expansion chambers, one for each feeding gas, and a number of orifices (9) (11) which distribute the gas contained in each of the volumes defined by said expansion chambers (8) (10). With this structure the expansion chambers (8) of the outer cap (6) are in direct communication with the gas feeding supplies (4), the distribution conduits (9) of the outer cap (6) communicate chamber (8) with expansion chambers (10) of the inner cap (7) and finally, distribution conduits (11) of the inner cap (7) establish a communication with the detonation chamber (1). Obviously, this embodiment may be achieved with a single cap internally coupled to the detonation chamber (1) and which communicates gas feeding supplies (4) and detonation chamber (1) through an expansion chamber (8) and a number of distribution conduits (9), for each feeding supply.

With this so, channels (8) (10) define a set of independent chambers or volumes, as if manifolds, each directly communicated with one of the gas feeding supplies (4) so that each gas may reach the detonation chamber (1) without mixing with the other gases by means of several conduits (9) (11).

Figure 4:
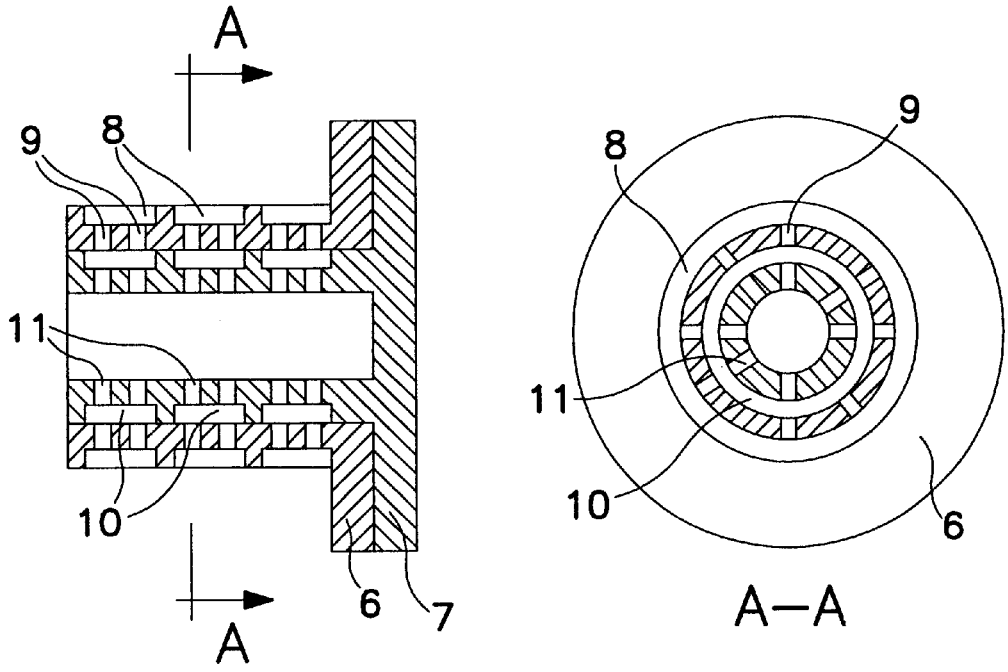
FIG. 4 shows an embodiment in which the gas feeding system consists of a single cylindrical cap provided, for each gas, with a radial expansion chamber and a number of distribution orifices which communicate with the detonation chamber.
Figure 5:
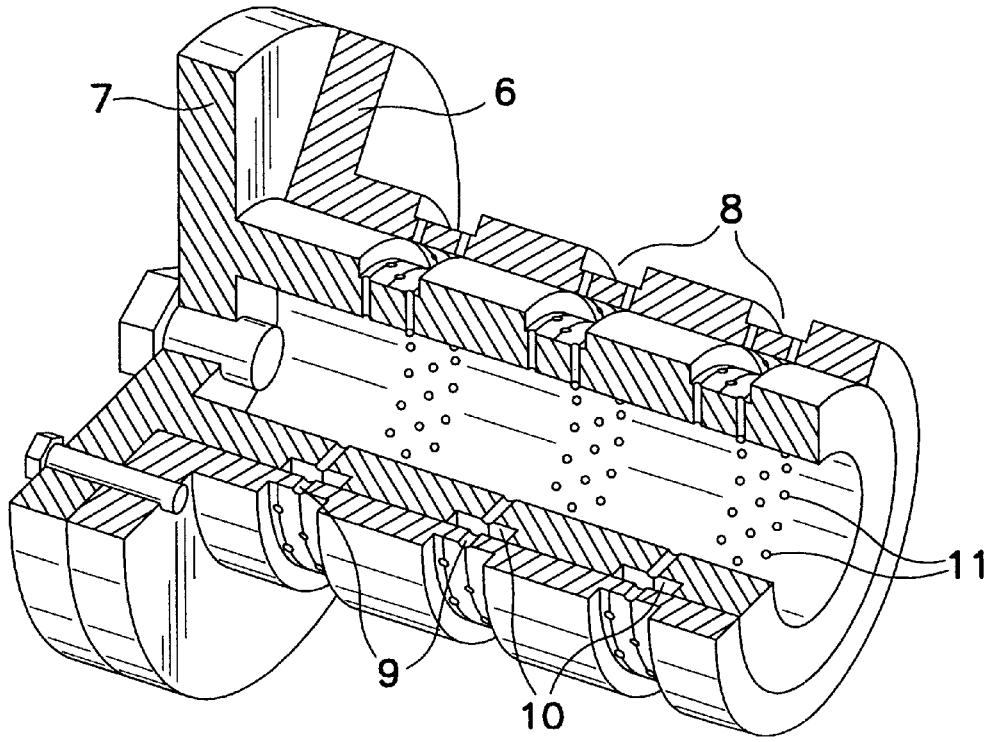
FIG. 5 shows a perspective view of the embodiment shown in FIG. 4, that is, where the feeding system consists of a cap provided with radial expansion chambers and a number of distribution orifices.

FIGS. 4 and 5 show a variation of the embodiment of FIG. 2, where channels (8) (10) of the caps (6) and (7) extend through the entire perimeter of the caps, forming annular channels which define expansion chambers, also annular, for each feeding gas. Obviously, this embodiment may be achieved with a single cap internally coupled to the detonation chamber (1) and which communicates gas feeding supplies (4) and detonation chamber (1) through an expansion chamber (8) and a number of distribution conduits (9), for each feeding supply, as shown in FIG. 1.

Figure 6:
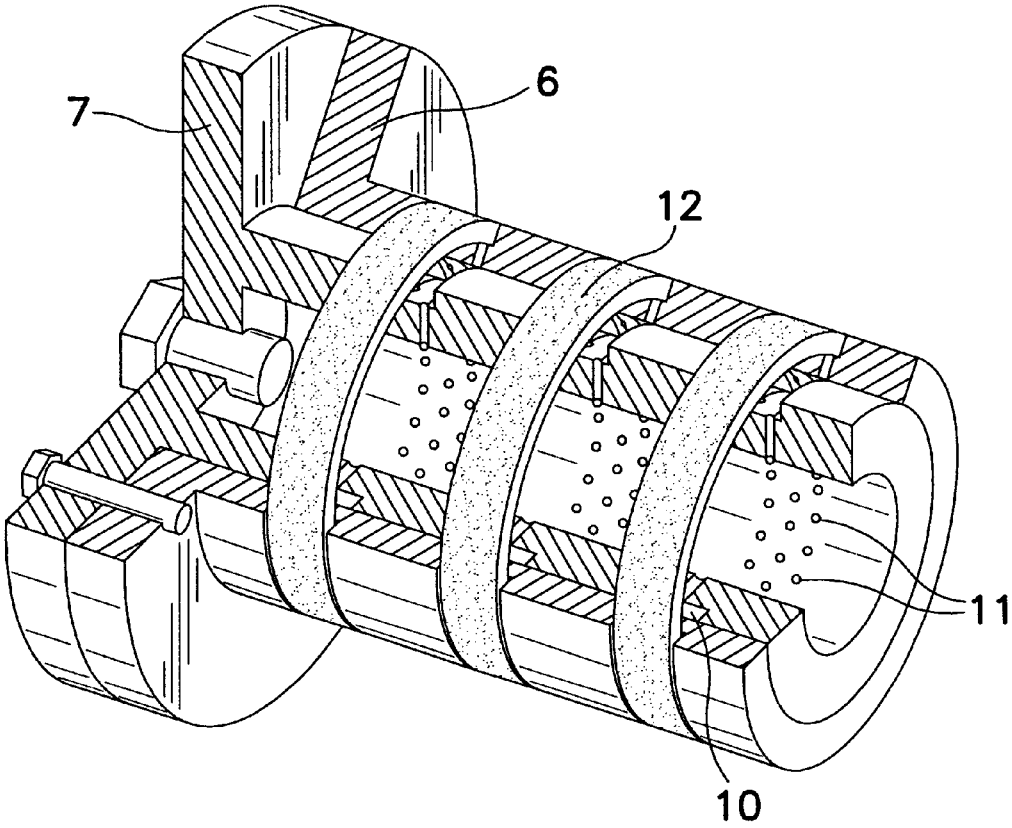
FIG. 6 shows an embodiment of the feeding system using a porous material.

FIG. 6 shows an embodiment in which a porous material (12) is placed in the volume determined by the expansion chambers (8) of the outer cap (6), which precludes the progress of the pressure wave through it.

Figure 7:
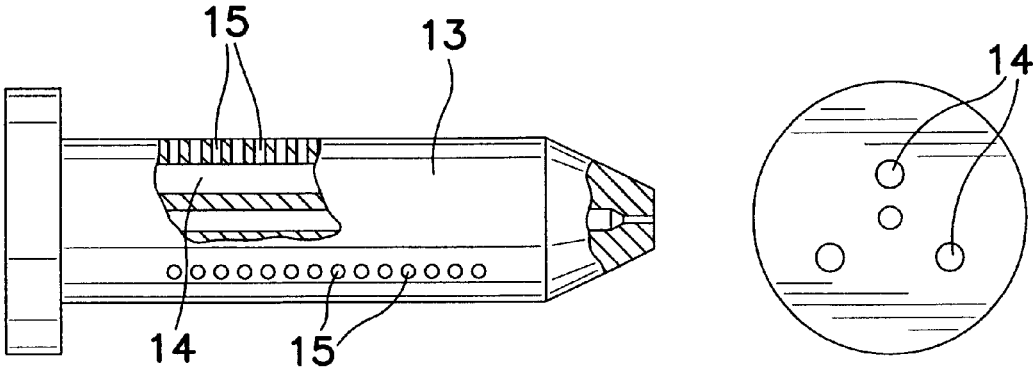
FIG. 7 shows an embodiment of the feeding system where the feeding system consists of an axial rod or cylinder, provided with an axial expansion chamber for each of the gases and a number of distribution orifices which open into the detonation chamber.

FIG. 7 shows an embodiment in which the feeding system is materialized in a central rod or cylinder (13) placed inside and concentric to the detonation chamber (1) which incorporates a set of longitudinal conduits (14) which make up longitudinal expansion chambers and a number of radial orifices (15) which are part of the corresponding distribution ducts which communicate each expansion chamber with the detonation chamber through several points distributed around the aforementioned rod (13).

Figure 8:
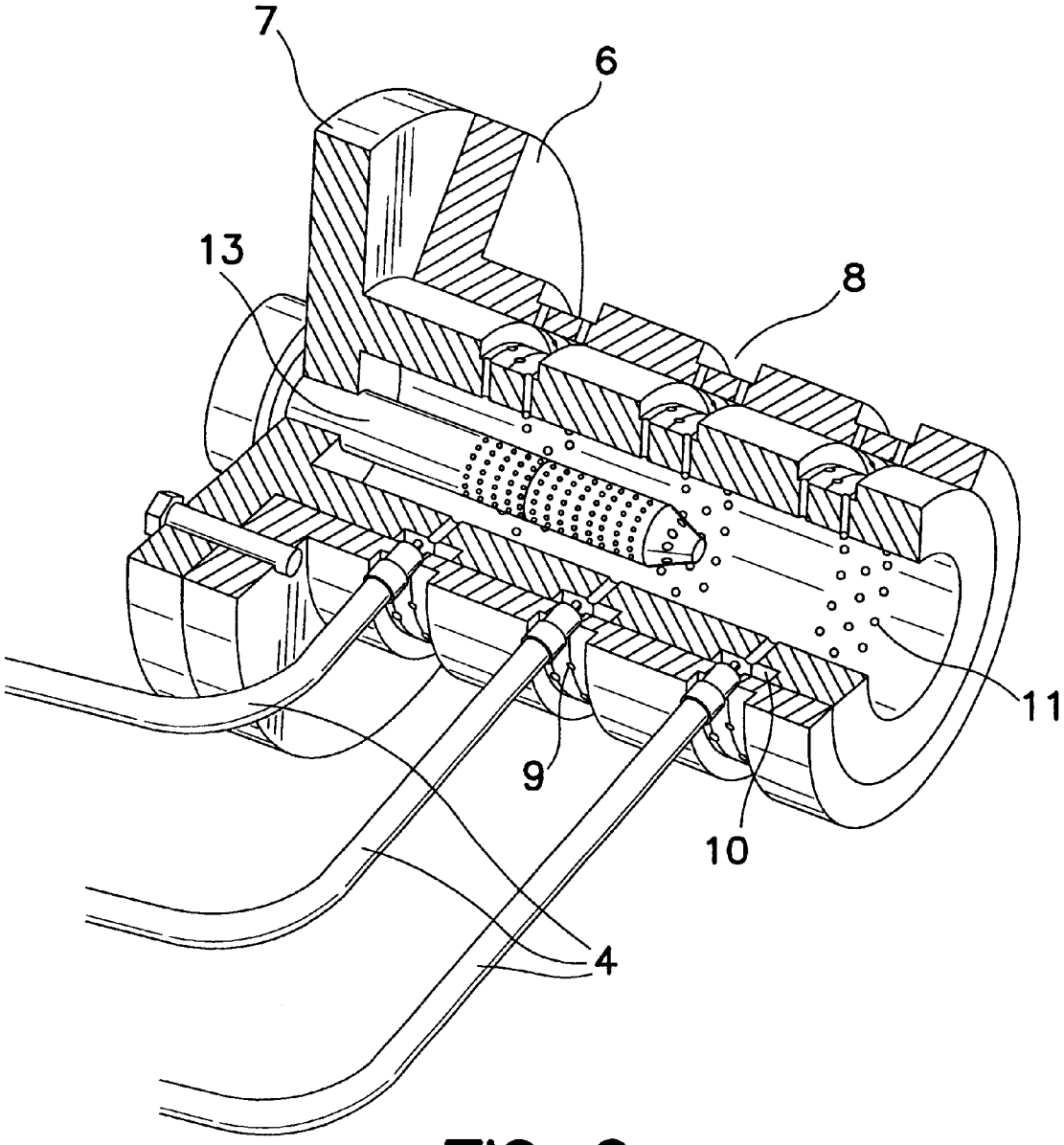
FIG. 8 shows an embodiment of a detonation spray device where the gas feeding system includes two concentric caps and a cylinder.

FIG. 8 shows another embodiment of a detonation spray device. The detonation spray device as shown in FIG. 8 includes two caps (6) (7) each of which has a set of passages and a cylinder (13). Each of the passage of the outer cap (6) includes the expansion chamber (8) connected to a corresponding supply line (4) and a number of distribution conduits (9) being communicated with the expansion chamber (8). Each of the passage of the inner cap (7) includes the expansion channel (10) and a number of distribution conduits (11) forming annular sectors for supplying gases. The cylinder (13) is an additional gas feeding system and one embodiment thereof is shown in FIG. 7.

One of the main advantages of the invention refers to the fact that feeding of each gas is performed, whether radially, annularly or axially, through an independent passage, so that the gases remain separate until they reach the detonation chamber, inside which the fuel mixture is made directly, without the presence of any other volume or conduit containing a fuel mixture. In this way, even if there is a certain backfiring reaching any gas feeding passage, no combustion can take place, much less a detonation, since each of the gases on their own cannot burn nor much less explode.

With this apparatus the feeding of gas is continuous, that is, there are no valves or mechanical elements of any other type which open or close the gas feeding to the detonation gun, gas feeding taking place directly from the feeding supplies to the detonation chamber (1) in which the fuel mixture is made and its ignition, by the spark plug, first producing the combustion of the mixture and then the detonation, which advances both through barrel (2) and through the passages. The advance of the detonation wave through the passages blocks the feeding of gas to the detonation chamber, thus directly converting, that is without valves or other mechanical devices, the continuous feeding of gases into a cyclical feeding of the detonation chamber which allows cyclical detonations and therefore very effective ones. It must be remembered that the propagation speed in a combustion process is substantially slower than that of a detonation process.

It is not considered necessary to extend this description further for any expert in the field to understand the scope of the invention and the advantages derived thereof.

The materials, shape, size and arrangement of the elements are subject to variation as long as they do not imply a change in the essence of the invention.

The terms used in this document shall always be understood in a wide and non-limiting sense.

What is claimed is:

1. A gas injection system for a detonation thermal spray device comprising:

a combustion chamber for receiving fuel and an oxidant to generate a combustible mixture and for detonating the combustible mixture to form a wave of hot detonated gas products that propel a powder through a barrel for forming a thermal spray coating; and a set of independent passages, each independent passage having at least one expansion chamber and a plurality of distribution conduits communicated to the expansion chamber for separate feeding of the fuel and oxidant to eliminate combustible mixtures within the set of independent passages and for providing a valve-free open path to the combustion chamber, the set of independent passages having at least one independent passage for the fuel and at least one independent passage for the oxidant, each of the set of independent passages opening to the combustion chamber through a plurality of gas injection openings distributed to facilitate the effective mixing of a combustible mixture prior to its ignition in each detonation cycle; and the set of independent passages providing a cooling path for a portion of the wave of the hot detonated gas products received from the combustion chamber after each ignition and detonation of the combustible mixture to form a cooled volume of detonated gas products and then being for injecting the cooled detonated gas products ahead of additional fuel and additional oxidant into the combustion chamber with the cooled volume of detonated gas products forming a gaseous thermal barrier between the hot detonated gas products remaining in the combustion chamber after each ignition and detonation of the subsequent combustible mixture formed from the additional fuel and additional oxidant injected into the combustion chamber that mix and ignite to generate and repeat the detonation cycle.

2. The gas injection system of claim 1 wherein the distribution conduits have sufficient cross section to allow the filling of the combustion chamber with the combustible mixture for each of the detonation cycles.

3. The gas injection system of claim 1 wherein the set of independent passages are formed in a cap.

4. The gas injection system of claim 3 wherein the gas injection openings inject the fuel and oxidant in a radial pattern into the combustion chamber.

5. The gas injection system of claim 4 wherein the cap includes two concentric components, an outer component for housing a first set of expansion chambers and distribution conduits and an inner component for housing a second set of expansion chambers and distribution conduits and wherein the distribution conduits of the outer housing communicate with the expansion chambers of the inner housing.

6. The gas injection system of claim 4 wherein the independent passages surround the perimeter of the combustion chamber.

7. The gas injection system of claim 1 wherein a porous material within at least one of the set of independent passages inhibits the advancement of the portion of the hot detonated gas products received from the combustion chamber.

8. The gas injection system of claim 1 wherein the set of independent passages are formed in a central rod contained within the combustion chamber.

9. A gas injection system for a detonation thermal spray device comprising:

a combustion chamber for receiving fuel and an oxidant to generate a combustible mixture and for detonating the combustible mixture to form a wave of hot detonated gas products that propel a powder through a barrel for forming a thermal spray coating;

a set of independent passages within a cap, each independent passage having at least one expansion chamber and a plurality of distribution conduits communicated to the expansion chamber for separate feeding of the fuel and oxidant to eliminate combustible mixtures within the set of independent passages and for providing a valve-free open path to the combustion chamber, the set of independent passages having at least one independent passage for the fuel and at least one independent passage for the oxidant, each of the set of independent passages opening to the combustion chamber through a plurality of gas injection openings distributed to facilitate the effective mixing of a combustible mixture prior to its ignition in each detonation cycle; and the set of independent passages providing a cooling path for a portion of the wave of the hot detonated gas products received from the combustion chamber after each ignition and detonation of the combustible mixture to form a cooled volume of detonated gas products and then being for injecting the cooled detonated gas products ahead of additional fuel and additional oxidant into the combustion chamber with the cooled volume of detonated gas products forming a gaseous thermal barrier between the hot detonated gas products remaining in the combustion chamber after each ignition and detonation of the subsequent combustible mixture formed from the additional fuel and additional oxidant injected into the combustion chamber that mix and ignite to generate and repeat the detonation cycle; and a detonation device for initiating each detonation cycle.

10. The gas injection system of claim 9 wherein the distribution conduits have sufficient cross section to allow the filling of the combustion chamber with the combustible mixture for each of the detonation cycles.

11. The gas injection system of claim 9 wherein the gas injection openings inject the fuel and oxidant in a radial pattern into the combustion chamber.

12. The gas injection system of claim 11 wherein the cap includes two concentric components, an outer component for housing a first set of expansion chambers and distribution conduits and an inner component for housing a second set of expansion chambers and distribution conduits and wherein the distribution conduits of the outer housing communicate with the expansion chambers of the inner housing.

13. The gas injection system of claim 11 wherein the independent passages surround the perimeter of the combustion chamber.

14. The gas injection system of claim 9 wherein a porous material within at least one of the set of independent passages inhibits the advancement of the portion of the hot detonated gas products received from the combustion chamber.

15. The gas injection system of claim 9 wherein the set of independent passages are formed in a central rod contained within the combustion chamber.

16. A gas injection system for a detonation thermal spray device comprising:

a combustion chamber for receiving fuel and an oxidant to generate a combustible mixture and for detonating the combustible mixture to form a wave of hot detonated gas products that propel a powder through a barrel for forming a thermal spray coating; and a set of independent passages within a central rod contained within the combustion chamber, each independent passage having at least one expansion chamber and a plurality of distribution conduits communicated to the expansion chamber for separate feeding of the fuel and oxidant to eliminate combustible mixtures within the set of independent passages and for providing a valve-free open path to the combustion chamber, the set of independent passages having at least one independent passage for the fuel and at least one independent passage for the oxidant, each of the set of independent passages opening to the combustion chamber through a plurality of gas injection openings distributed to facilitate the effective mixing of a combustible mixture prior to its ignition in each detonation cycle; and the set of independent passages providing a cooling path for a portion of the wave of the hot detonated gas products received from the combustion chamber after each ignition and detonation of the combustible mixture to form a cooled volume of detonated gas products and then being for injecting the cooled detonated gas products ahead of additional fuel and additional oxidant into the combustion chamber with the cooled volume of detonated gas products forming a gaseous thermal barrier between the hot detonated gas products remaining in the combustion chamber after each ignition and detonation of the subsequent combustible mixture formed from the additional fuel and additional oxidant injected into the combustion chamber that mix and ignite to generate and repeat the detonation cycle; and a detonation device for initiating each detonation cycle.

17. The gas injection system of claim 16 wherein the distribution conduits have sufficient cross section to allow the filling of the combustion chamber with the combustible mixture for each of the detonation cycles.

18. The gas injection system of claim 16 wherein the gas injection openings inject the fuel and oxidant in a radial pattern into the combustion chamber.

19. The gas injection system of claim 16 wherein a porous material within at least one of the set of independent passages inhibits the advancement of the portion of the hot detonated gas products received from the combustion chamber.

* * * * *